US008029332B2

(12) United States Patent
Nadsady et al.

(10) Patent No.: US 8,029,332 B2
(45) Date of Patent: Oct. 4, 2011

(54) REUSEABLE ADHESIVE BRA CUPS

(75) Inventors: Kathleen Nadsady, Ventura, CA (US); Ann Deal, Ventura, CA (US)

(73) Assignee: Ce Soir Lingerie Co., Inc., Ventura, CA (US)

( * ) Notice: Subject to any disclaimer, the term of this patent is extended or adjusted under 35 U.S.C. 154(b) by 379 days.

(21) Appl. No.: 11/921,674

(22) PCT Filed: Jun. 9, 2006

(86) PCT No.: PCT/US2006/022900

§ 371 (c)(1),
(2), (4) Date: Jul. 20, 2009

(87) PCT Pub. No.: WO2007/030177

PCT Pub. Date: Mar. 15, 2007

(65) Prior Publication Data

US 2009/0298386 A1 Dec. 3, 2009

Related U.S. Application Data

(60) Provisional application No. 60/689,264, filed on Jun. 9, 2005.

(51) Int. Cl.
*A41C 3/00* (2006.01)

(52) U.S. Cl. ..... 450/38; 450/57

(58) Field of Classification Search ..... 450/36–38, 450/54–57; 2/267, 268; 623/7, 8
See application file for complete search history.

(56) References Cited

U.S. PATENT DOCUMENTS

| | | | | |
|---|---|---|---|---|
| 5,362,781 | A * | 11/1994 | Stein | 524/99 |
| 6,183,340 | B1 * | 2/2001 | Wen | 450/81 |
| 6,231,424 | B1 * | 5/2001 | Valentin | 450/81 |
| 6,241,715 | B1 * | 6/2001 | Houser et al. | 604/385.07 |
| 6,257,952 | B1 * | 7/2001 | Valentin | 450/81 |
| 6,371,831 | B1 * | 4/2002 | Dodge | 450/81 |
| 6,383,055 | B2 * | 5/2002 | Valentin | 450/81 |
| 6,780,081 | B2 * | 8/2004 | Chen et al. | 450/81 |
| 6,814,648 | B2 * | 11/2004 | Chong | 450/81 |
| 6,852,001 | B2 * | 2/2005 | Chen et al. | 450/57 |
| 6,916,224 | B2 * | 7/2005 | Chen et al. | 450/57 |
| 6,964,596 | B1 * | 11/2005 | Abramyan | 450/81 |
| 7,052,359 | B2 * | 5/2006 | Chen et al. | 450/54 |
| 7,144,296 | B2 * | 12/2006 | Chen et al. | 450/81 |
| 7,163,433 | B2 * | 1/2007 | Chou | 450/81 |
| 7,278,899 | B2 * | 10/2007 | Davis | 450/81 |
| 7,335,086 | B1 * | 2/2008 | Karon | 450/81 |
| 7,407,429 | B2 * | 8/2008 | Chen | 450/54 |

* cited by examiner

*Primary Examiner* — Gloria Hale
(74) *Attorney, Agent, or Firm* — Arthur Freilich

(57) ABSTRACT

A reusable adhesive bra, comprising: a fabric bra having a pair of bra cups, each of the bra cups having a forwardly facing surface and a rearwardly facing surface; a pair of bra forms adapted to be matingly received in the pair of bra cups, each of the bra forms having a forwardly facing surface and rearwardly facing surface; each of the bra form forwardly facing surfaces adapted to be removably fastened to a respective one of the bra cup rearwardly facing surfaces of the fabric bra; each of the bra forms having a substantially centrally disposed hole therethrough; each of the bra form rearwardly facing surfaces having a reusable adhesive coating adapted to be removably fastened to a respective one of a user's breasts and having the substantially centrally disposed hole surrounding a respective one of the user's nipples, when the reusable adhesive bra is worn by the user.

6 Claims, 10 Drawing Sheets

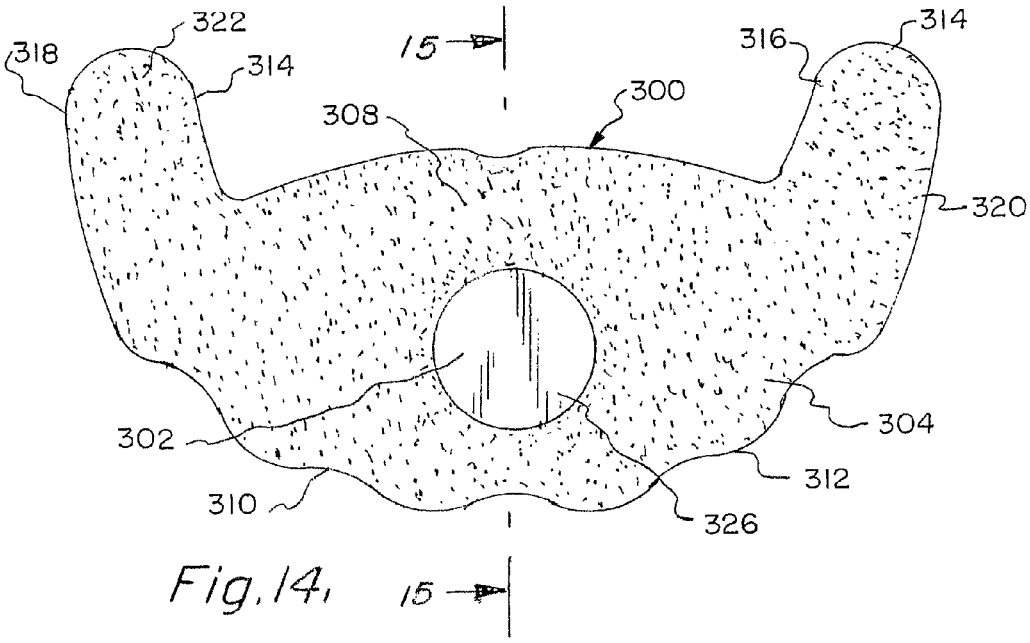
Fig. 14,
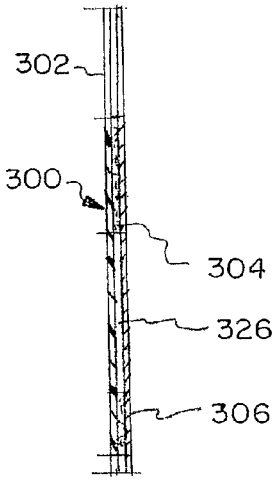
Fig. 15,
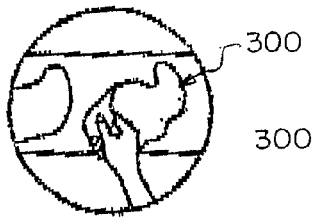
Fig. 16a,
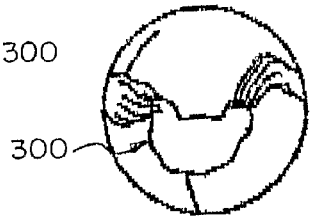
Fig. 16b,
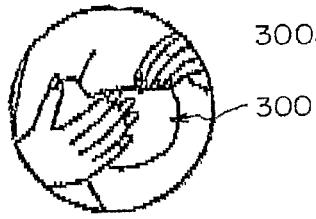
Fig. 16c,
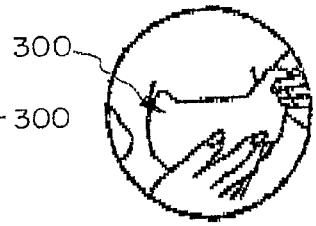
Fig. 16d,

REUSEABLE ADHESIVE BRA CUPS

This application claims the benefit of U.S. Provisional Application No. 60/689,264, filed Jun. 9, 2005.

BACKGROUND OF THE INVENTION

1. Field of the Invention

The present invention relates generally to bra covers and more particularly to reusable adhesively attached breast cups, breast covers, bras, and brassieres.

2. Background Art

Since the advent of women's garments having plunging necklines and backless tops, women have started to wear backless and strapless brassieres, cups or nipple covers, to present an attractive image, while showing modesty and still projecting an enticing, revealing image. Most of these covers are adhesively secured to the skin of the user, such as by strips of double-sided adhesive or a layer of pressure sensitive adhesive. Some of these layers of adhesive are reusable. However, the adhesive also adheres to the sensitive nipple area of the breast, and it is painful when the cup is removed from the breast. The surface of the adhesive layer also accumulates lint, sweat, lotion, etc. and loses its adhesiveness. Attempts to wash the brassiere or cup in water with detergent often result in the tackiness of the adhesive decreasing each time the brassiere or cup is washed, such that after a few washings, the adhesive layer no longer sticks to the skin of the user.

There is thus a need for breast cups, breast covers, bras, and brassieres having reusable adhesives that can adhere to a user's breasts numerous times, retain adhesive properties, especially after being worn and washed a number of times, and be absent of adhesive in the sensitive nipple area of most users. The breast cups, breast covers, bras, and brassieres should be comfortable safe to wear, easy to store, and capable of being placed on and removed from the user's breasts numerous times easily and conveniently.

The breast cups, breast covers, bras, and brassieres should provide and facilitate a woman's ability to look, feel, have lift, provide cleavage, and support to her breasts, based on her own desires and needs, be usable in a variety of situations and social occasions, be capable of being adapted to enhance the user's breasts, provide additional support and lift, and additional cleavage, as needed and desired by the user, while having a natural appearance, resilience, and appeal comparable to that of the user's breasts. The breast cups, breast covers, bras, and brassieres should be comfortable, attractive, easy to put on and remove from the user's breasts, long lasting, durable, inexpensive, quick, easy, and convenient to apply and remove from the user's breasts, easy and convenient to store when not in use, and of simple construction.

Different breast cups, breast covers, bras, and brassieres have heretofore been known. However, none of the breast cups, breast covers, bras, and brassieres adequately satisfies these aforementioned needs.

U.S. Pat. No. 6,371,831 (Dodge) discloses a strapless swimsuit top and method of donning same. The strapless swimsuit top comprises waterproof adhesive attached to a fabric cup sized and shaped to admit a female breast. The waterproof adhesive co-extends with the fabric except in an adhesive-free nipple area. An adhesive backing sheet co-extends with the adhesive and protects the adhesive until such time as the strapless swimsuit top is to be installed. Steps of donning the strapless swimsuit top include removing the adhesive backing sheet, sliding a strapless swimsuit top lower edge upwards over a thorax towards a breast lower surface, positioning the strapless swimsuit top lower edge at an intersection of the thorax and breast lower surface such that the adhesive-free nipple area is directly below a nipple, and a sufficient distance away from the nipple that when the strapless swimsuit top is rolled up over the breast, the adhesive-free nipple area will coextend with the nipple; rolling the strapless swimsuit top up over the breast, taking care to ensure that the nipple is covered by the adhesive-free nipple area, whereby contact between said waterproof adhesive is avoided, thereby preventing chafing and irritation of the nipple.

U.S. Pat. No. 6,036,577 (Coburn) discloses a disposable breast pad, which comprises a circular body having a surface profile adapted to conform to the contour of the female breast. A portion of the circular body is cut out and removed to form an opening in the circular body. An insert is provided to cover the opening. The insert is attached to the circular body, is made of mesh material, has elastic strands sewn therein, and allows the pad to expand, if necessary, thereby ensuring a comfortable fit for breasts of different sizes and shapes. A pressure sensitive skin safe adhesive is used to secure the pad directly to the breast.

U.S. Pat. No. 4,333,471 (Nakai) discloses a disc-shaped nipple cover that has a flexible paper backing sheet covered with pressure sensitive adhesive and a centrally disposed soft felt pad. Release paper coverings protect the nipple cover until removal prior to usage.

U.S. Pat. No. 4,640,288 (Hattori) discloses an adhesive pad for use on human body, which is particularly suitable for women's use as a nipple cover or protector for afflicted portions, such as the heel suffering shoe sore. The adhesive pad comprises a flexible sheet of diaphanous plastic material and an adhesive coating formed on the periphery of the underside of the sheet, so as to define inside thereof a non-adhesive and translucent area that is in adhesive-free covering contact with a particular portion on the body to be protected. Accordingly, the portion of the body can be seen through the adhesive pad, so that the pad itself can be undiscerned to present natural appearance of the body, while protecting that portion from being rubbed or injured.

U.S. Pat. No. 6,200,195 (Furuno, et al.) discloses an adhesive pad and method for its production, including a low irritant adhesive pad that can retain its adhesion for repeated use, and a process for its production. The adhesive pad may be adhered to a human body and comprises a pad body made of silicone rubber, and a silicone gel adhesive layer integrally formed on the pad body to provide an adhesive surface.

U.S. Pat. No. 4,992,074 (Diaz) discloses a soft, reusable, self-supporting bra, comprised of two independent shaped forms having a plastic foam construction, and formed so as to have the desired shape. The forms may be worn underneath a conventional bra or bathing suit and are washable. Self-adhesive strips are included to hold the bra forms to the wearer. The strips are cut so as to overlay part of the bra, holding the bra forms in place without adhering to the wearer's breast skin.

U.S. Pat. No. 6,857,935 (Dohan) discloses reusable adhesive body apparel, which includes a decorative component and an adhesive component coupled to the decorative component. The adhesive component is formed of a material that permits the apparel to be reused multiple times. In one configuration, the apparel includes an adhesive tape with a decorative image provided on a non-adhesive surface of the tape, and a gel coupled to the adhesive surface of the tape. In another configuration, the apparel includes a decorative component with an uneven surface topography, and an adhesive gel. The apparel may be used, for example, as a breast cover, a bathing suit, a costume, or a tattoo.

U.S. Pat. No. 6,767,632 (Axelgaard, et al.) discloses a dermal fastener that includes a first adhesive for adherence to an article and a second adhesive for adherence to skin. The second adhesive is a non-liquid water containing film including an organic polymer plasticized with a polyhydric alcohol with the organic polymer being derived from a monomeric mixture including from about 2 to about 30 pph acrylic acid to about 1 to about 30 pph of a glycolvinylether and about 0.01 to about 1.5 pph of a crosslinking agent. The first and second adhesives may also be disposed on opposite sides of a membrane if partition of fluid components in the adhesives is desired.

U.S. Pat. No. 6,183,340 (Wen) discloses a brassiere cup, comprising a self-adhesive frustum made of self-adhesive neurost imulation, a self-adhesive cone made of self-adhesive neurost imulation and having a center hole, and a conical cup made of silicon rubber and having an inner side formed with a first annular recess around a circumference of the inner side and configured to receive the self-adhesive frustrum, a second annular recess spaced apart from the first annular recess and configured to receive the self-adhesive cone, and a plurality of protuberances between the first and second annular recesses for massaging breasts, whereby a user can wear strapless dresses or dresses with shoestring straps without worrying about exposure of her nipples.

U.S. Pat. No. 5,755,611 (Noble, et al.) discloses a self-supporting breast cup, including a soft, natural breast-shape cup portion for receiving a portion of the breast and a flat, peripheral flange portion which may be secured to the body of the wearer immediately beneath the breast by adhesive tape and renewer adhesive to permit the device to be worn repeatedly.

U.S. Pat. No. 6,857,932 (Chen) discloses a breast form encased with fabric laminated thermoplastic film, which includes a breast form, comprising a flexible chamber formed from a pair of polyurethane sheets that are sealed together along a perimeter edge of the chamber. A volume of silicone gel composition is sealably disposed within the flexible chamber. A fabric material is disposed over and permanently joined to a surface portion of each of the polyurethane sheets. The fabric material forms an exterior surface of the breast form, and is made from a four-way stretchable fabric. A pressure-sensitive adhesive is permanently grown to the fabric layer of the interior surface of the breast form.

U.S. Pat. No. D294,650 (De Beys) discloses an ornamental design for a self-adhesive breast supporting article, and U.S. Pat. No. D485,965 (Slimak, et al.) discloses an ornamental design for an adhesive bra support.

U.S. Pat. No. 6,758,720 (Chen) and U.S. Pat. Nos. 6,582,001, 6,780,081, 6,916,224 (Chen, et al.) disclose an attachable breast form enhancement system and a backless strapless bra, each comprising a pair of breast forms adjoined by a connector. The breast forms have an interior surface with a pressure sensitive adhesive layer that adjoins to the user's breasts. The pressure sensitive adhesive layer can be a permanently grown pressure sensitive adhesive that has an adhesion force to the breast forms that is greater than a cohesion force to the user's breasts. The connector adjoins the separated breast forms by attaching to the inner sides of the breast forms and pulling the user's breasts together.

U.S. Pat. No. 5,693,164 (Chang) discloses a method for making a breast enhancer, comprising placing a first and second film of thermoplastic material adjacent one another and forming a temporary adhesion seal therebetween. The temporary seal is in the form of a band that defines a perimeter of a bag formed between the two films. A sufficient volume of liquid silicone composition to form the breast enhancer is introduced into the bag, and the air-bubble free filled bag is placed between a top mold and a bottom mold. The top and bottom molds are compressively engaged to encase the filled bag within a mold cavity formed between the mold surfaces. At least a portion of the sealed band is disposed within the mold cavity, and at least a portion of the band is compressed between a seal surface of the top mold and a rim of the bottom mold. The temporary seal is opened to allow the liquid silicone composition to migrate between the films and fill the mold cavity. The liquid silicone composition is cured, and a weld is formed between film portions positioned between the rim and seal surface. The top mold is withdrawn from the bottom mold, the breast enhancer is removed from the bottom mold, excess edges of the films are trimmed off, and the breast enhancer is ready for packaging and shipping.

U.S. Pat. No. 3,276,449 (Morgan), U.S. Pat. No. 2,869,553 (D'Or), U.S. Pat. No. 2,728,079 (Williams), and U.S. Pat. No. 5,782,672 (Woodley) describe an adhesive brassiere, a disposable brassiere, a breast support, and a nipple pad, respectively, each of which use an adhesive to fasten the respective device or devices to a wearer's skin.

U.S. Pat. Nos. 6,397,391 and 6,257,951 (DeMarco) disclose a reusable backless, strapless, one-piece bra. The bra comprises an underwire, a light-weight aluminum layer and a rubber foam layer, the light weight aluminum layer being positioned between foam rubber layers. The aluminum enables the bra to be molded to fit the contours of each person. The foam is bonded to the skin with double-sided, disposable dermal adhesive tape. The tape is applied horizontally across the bottom of the bra and attached to the rib cage just beneath the breast. A pad may be provided on an inner surface of the bra to give the appearance of enhanced breast size.

U.S. Pat. No. 6,761,614 (Pinna) discloses a self-sustaining female breast support, formed from a thin, flexible, soft, elongate sheet of shaped profile made from synthetic material, one of its surfaces being at least partly covered by a thin layer of skin-compatible adhesive, on its other surface there resting an elongate sprung bar formed of semi-rigid synthetic material, its two ends being fixed to the flexible sheet, the adhesive layer being made to adhere to the lower part of the breast, which is widened and maintained raised by the action of the sprung bar in the manner of a leaf spring.

U.S. Pat. No. 6,545,042 (Davis) disclose a strapless swimsuit top and method of donning same and a backless, strapless bra with swivel system, each of which also use an adhesive to fasten the respective device or devices to a wearer's skin. U.S. Pat. No. 2,793,369 (Panighini) discloses a breast supporter, which also adheres to the wearer's skin.

For the foregoing reasons, there is a need for breast cups, breast covers, bras, and brassieres having reusable adhesives that can adhere to a user's breasts numerous times, retain adhesive properties, especially after being worn and washed a number of times, and be absent of adhesive in the sensitive nipple area of most users. The breast cups, breast covers, bras, and brassieres should be comfortable, safe to wear, easy to store, and capable of being placed on and removed from the user's breasts numerous times easily and conveniently.

The breast cups, breast covers, bras, and brassieres should provide and facilitate a woman's ability to look, feel, have lift, provide cleavage, and support to her breasts, based on her own desires and needs, be usable in a variety of situations and social occasions, be capable of being adapted to enhance the user's breasts, provide additional support and lift, and additional cleavage, as needed and desired by the user, while having a natural appearance, resilience, and appeal comparable to that of the user's breasts. The breast cups, breast covers, bras, and brassieres should be comfortable, attractive, easy to put on and remove from the user's breasts, long lasting, durable, inexpensive, quick, easy, and convenient to apply and remove from the user's breasts, easy and convenient to store when not in use, and of simple construction.

SUMMARY

The present invention is directed to breast cups, breast covers, bras, and brassieres having reusable adhesives that can adhere to a user's breasts numerous times, retain adhesive properties, especially after being worn and washed a number of times, and be absent of adhesive in the sensitive nipple area of most users. The breast cups, breast covers, bras, and brassieres are safe to wear, easy to store, and are capable of being placed on and removed from the user's breasts numerous times easily and conveniently.

The breast cups, breast covers, bras, and brassieres provide and facilitate a woman's ability to look, feel, have lift, provide cleavage, and support to her breasts, based on her own desires and needs, are usable in a variety of situations and social occasions, enhance the user's breasts, provide additional support and lift, and additional cleavage, as needed and desired by the user, while having a natural appearance, resilience, and appeal comparable to that of the user's breasts. The breast cups, breast covers, bras, and brassieres are comfortable, attractive, easy to put on and remove from the user's breasts, are long lasting, durable, inexpensive, quick, easy, and convenient to apply and remove from the user's breasts, and are easy and convenient to store when not in use, and of simple construction.

It has now been discovered, in accordance with the present invention that the irritation and pain on removal of an adhesively secured breast cup may be eliminated by providing an annular layer of adhesive on the inside of a breast cup, such that the adhesive is not present in a substantially centrally disposed portion of the inside surface of the breast cup, thus, having the user's nipple contact a soft material of the breast cup, breast cover, bra, or brassiere.

It has also been discovered that the washability of the adhesive layer is significantly improved by forming a layer of pressure sensitive adhesive silicone gel directly on the surface of a film or woven material forming a cup or cover for the bra, breast cup, breast cover, or brassiere. The adhesive layer is preferably formed by applying a layer of unsaturated silicone containing a thermally activated catalyst, such as platinum, to the sheet or cup material, and heating the coated cup or sheet to an elevated temperature to cure the layer of gel. The final bra, breast cup, breast cover, or brassiere can be washed at least ten times, and usually at least twenty five times in detergent without loss of adhesiveness.

Some women who only require a strapless bra may prefer that the reusable adhesive bra have a conventional rear strap with hook and eye or other releasable closure or side tab with adhesive to provide additional security and feeling of security. The present invention, thus, may also be provided with a short tab and a cooperating connector. The tab can be connected to two sides of a rear strap, each having an end containing a cooperating attachable connector or two short extensions with an inside adhesive layer.

A preferred configuration of the present invention includes a breast form having reusable adhesive on the side of a silicone gel breast form facing the user's breast and reusable adhesive on the opposing side of the breast form, an area substantially centrally disposed on the breast form facing the user's breast absent the reusable adhesive, and a bra having bra cups, with the opposing side of each of the breast forms having the reusable adhesive removably fastened to each of the bra cups, with the nipples of the user contacting the soft material of the bra cups.

Another configuration of the present invention includes hook and loop fasteners arranged in an annular configuration about the interior of each of the bra cups and an annular configuration of hook and loop fasteners about the exterior of each of the breast forms, the hook and loop fasteners of the breast cup and the hook and loop fasteners of the breast forms removably mating with the each other.

Another configuration of the present invention includes side tabs connected to each side edge of the cups. The inside surface of the side tab has first loop material adjacent the side edge and second strip of hook material or vice versa. During use of the bra or cup without additional support, the second strip can be folded back on the first layer to reduce contact of the skin with the hook material. When the side tab is to be used, the hook strip is separated from the loop layer and is then attached to adhesive extensions, back straps, etc., which, of course, can also be accomplished with snaps, zippers, hook-eyes, etc.

A reusable adhesive bra having features of the present invention comprises: a fabric bra having a pair of bra cups, each of the bra cups having a forwardly facing surface and a rearwardly facing surface; a pair of bra forms adapted to be matingly received in the pair of bra cups, each of the bra forms having a forwardly facing surface and a rearwardly facing surface; each of the bra form forwardly facing surfaces adapted to be removably fastened to a respective one of the bra cup rearwardly facing surfaces of the fabric bra; each of the bra forms having a substantially centrally disposed hole therethrough; each of the bra form rearwardly facing surfaces having a reusable adhesive coating adapted to be removably fastened to a respective one of a user's breasts and having the substantially centrally disposed hole surrounding a respective one of the user's nipples, when the respective one of the bra forms is removably fastened to the respective one of the bra cups of the fabric bra and the respective one of the bra forms is removably fastened to the respective one of the user's breasts.

DRAWINGS

These and other features, aspects, and advantages of the present invention will become better understood with regard to the following description, appended claims, and accompanying drawings where:

FIG. 14 is a rear view of another reusable adhesive bra, also constructed in accordance with the present invention;

FIG. 15 is a cross section view of the reusable adhesive bra of FIG. 14;

FIG. 16A is a perspective view of a step of a user placing the reusable adhesive bra of FIG. 14 on the user's breast;

FIG. 16B is a perspective view of another step of the user placing the reusable adhesive bra of FIG. 14 on the user's breast;

FIG. 16C is a perspective view of another step of the user placing the reusable adhesive bra of FIG. 14 on the user's breast;

FIG. 16D is a perspective view of another step of the user placing the reusable adhesive bra of FIG. 14 on the user's breast;

DESCRIPTION

The preferred embodiments of the present invention will be described with reference to FIGS. 1-25 of the drawings. Identical elements in the various figures are identified with the same reference numbers.

Reusable adhesive of the present invention is coated onto the inside surface of a film, sheet or cap to form a layer of gel. The coated product is placed on a tray, and the tray placed in an oven, until the gel is cured. The final product is removed, and a protective peel-off layer of thin film is placed over the outside surface of the adhesive gel to protect the product during packaging and shipping.

Washability of the adhesive layer is significantly improved by forming a layer of pressure sensitive adhesive silicone gel directly on the surface of a film or woven material forming a cup or cover for a bra, breast cup, breast cover, or brassiere. The adhesive layer is preferably formed by applying a layer of unsaturated silicone containing a thermally activated catalyst, such as platinum, to the sheet or cup material, and heating the coated cup or sheet to an elevated temperature to cure the layer of gel. The final bra, breast cup, breast cover, or brassiere can be washed at least ten times, and usually at least twenty five times in detergent without loss of adhesiveness.

Figure 1:
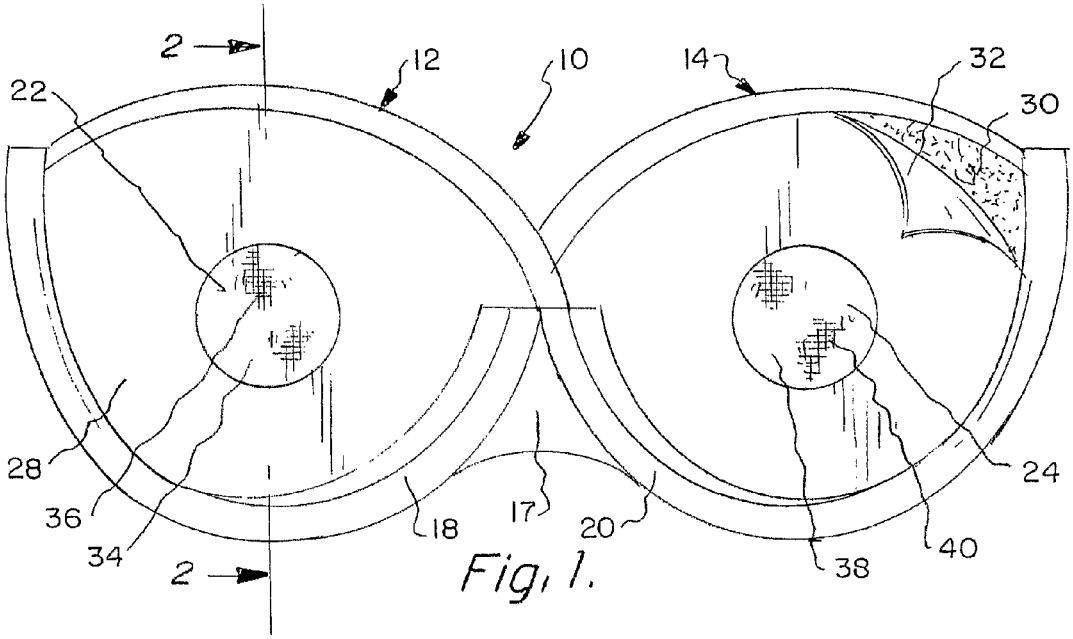
FIG. 1 is a rear view of a reusable adhesive bra, constructed in accordance with the present invention.
Figure 2:
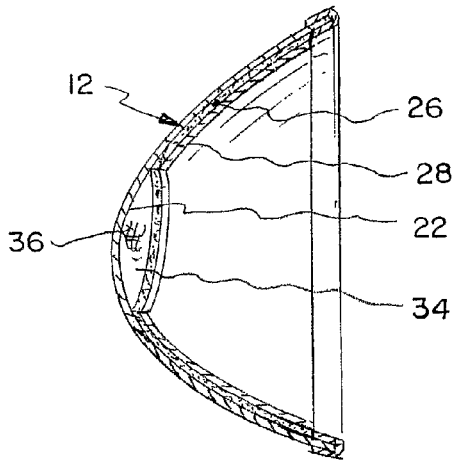
FIG. 2 is a cross section view of the reusable adhesive bra of FIG. 1.
Figure 3:
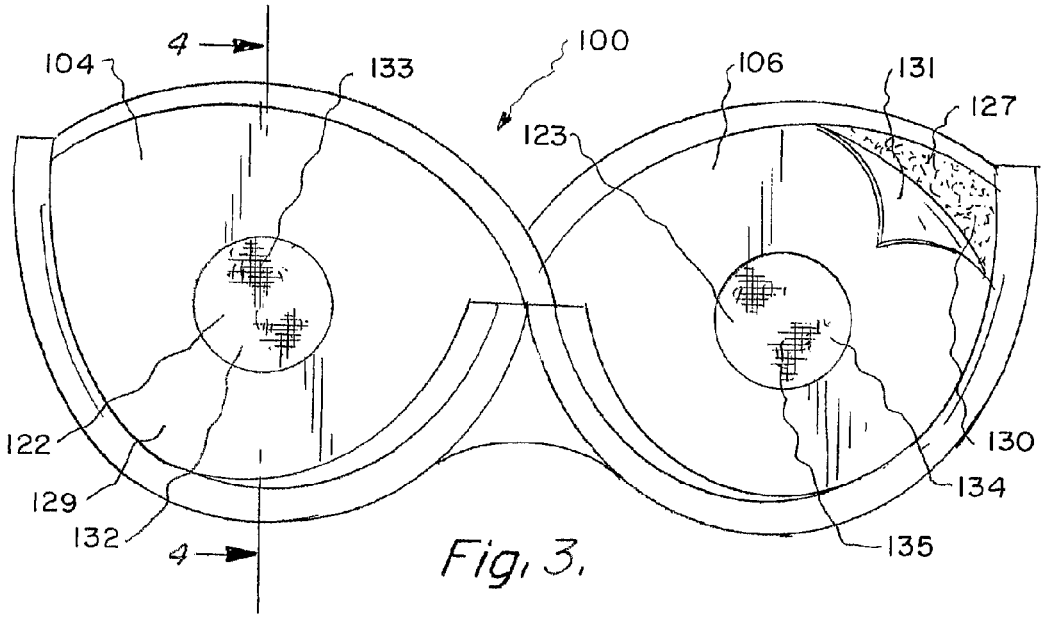
FIG. 3 is a rear view of another reusable adhesive bra comprising a fabric bra having hook and loop fasteners and reusable adhesive breast forms also having hook and loop fasteners, constructed in accordance with the present invention.
Figure 4:
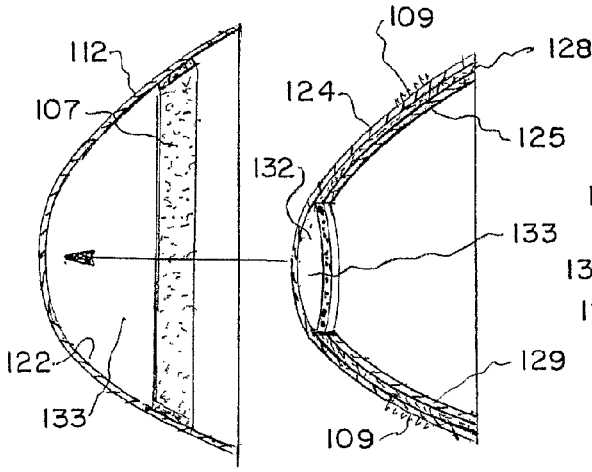
FIG. 4 is an exploded cross section view of the reusable adhesive bra of FIG. 3.
Figure 5:
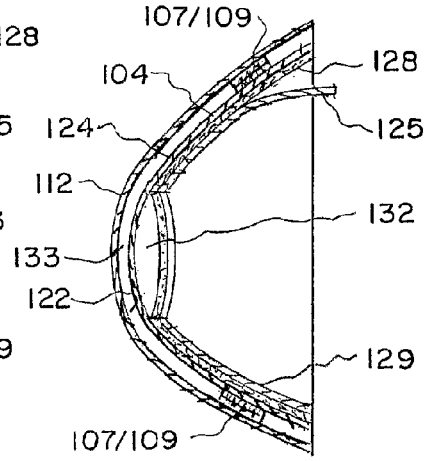
FIG. 5 is a cross section view of the reusable adhesive bra of FIG. 3.
Figure 6:
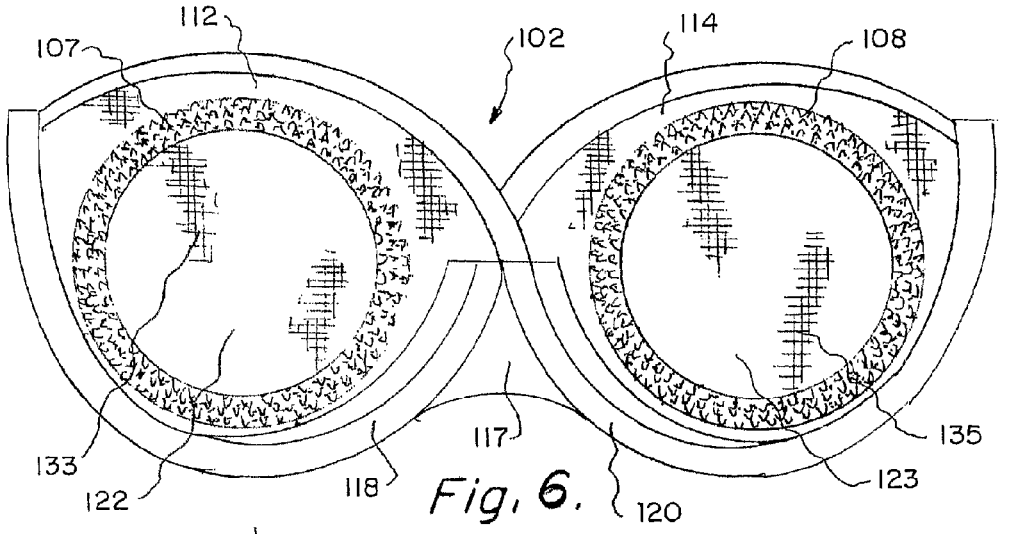
FIG. 6 is a rear view of the fabric bra of FIG. 3 having the hook and loop fasteners.
Figure 7A:
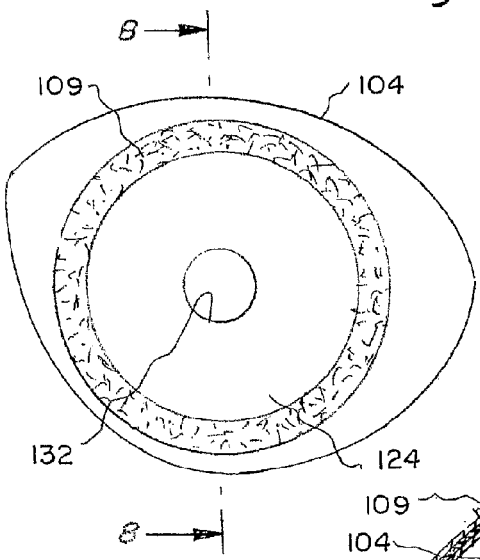
FIG. 7A is a front view of a reusable adhesive breast form of FIG. 3 having hook and loop fasteners.
Figure 7B:
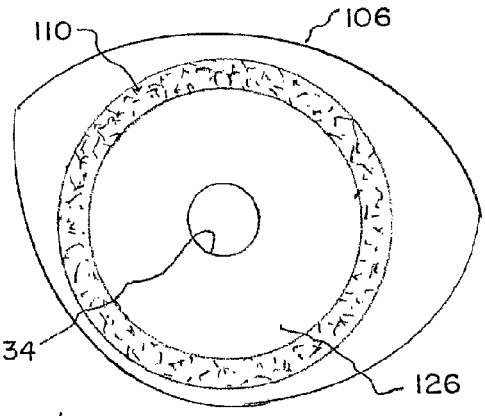
FIG. 7B is a front view of another reusable adhesive breast form of FIG. 3 also having hook and loop fasteners.
Figure 8:
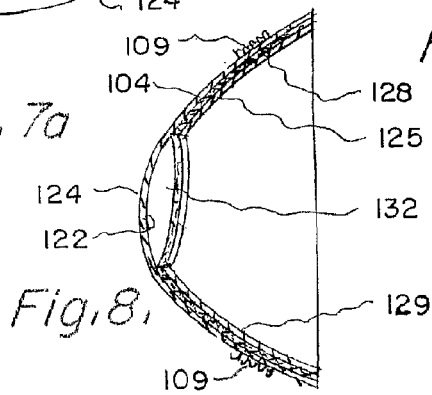
FIG. 8 is a cross section view of the reusable adhesive breast form of FIG. 3.
Figure 9:
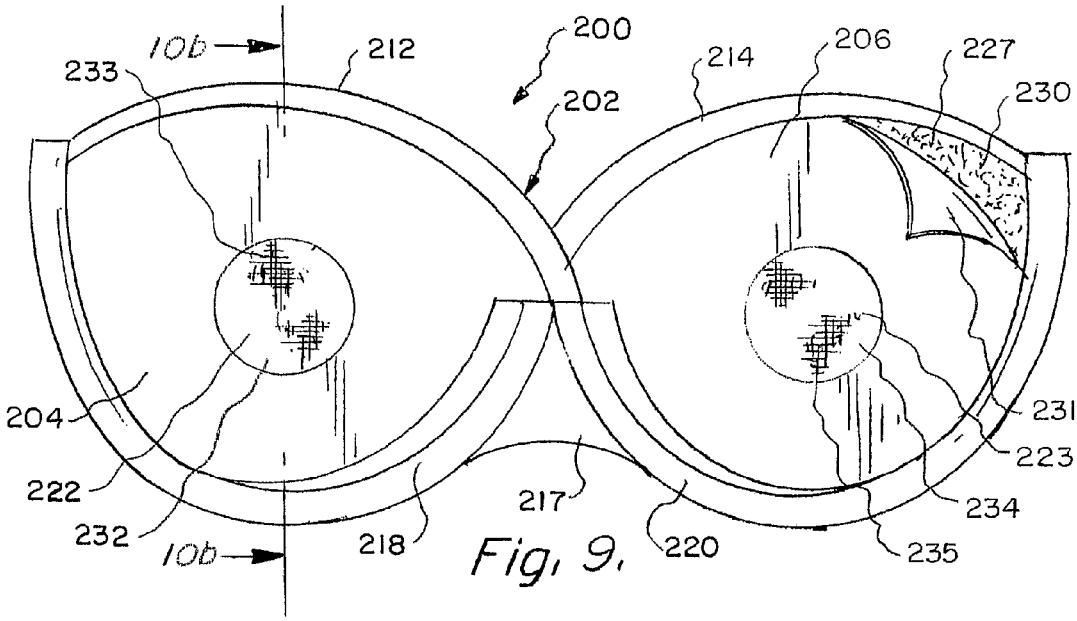
FIG. 9 is a rear view of another reusable adhesive bra comprising a fabric bra and reusable adhesive breast forms, constructed in accordance with the present invention.
Figure 10A:
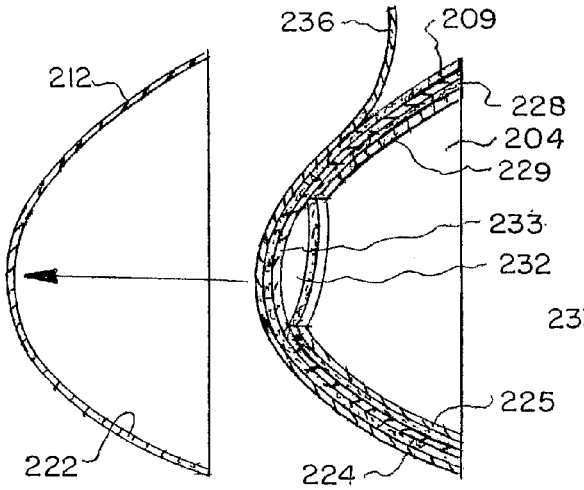
FIG. 10A is an exploded cross section view of the reusable adhesive bra of FIG. 9.
Figure 10B:
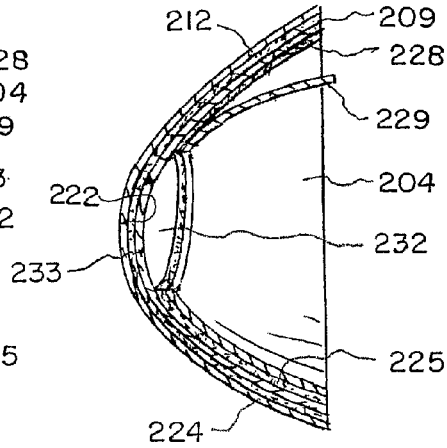
FIG. 10B is a cross section view of the reusable adhesive bra of FIG. 9.
Figure 11A:
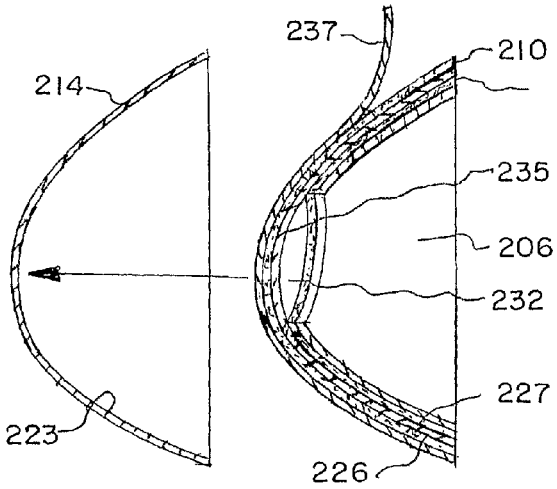
FIG. 11A is another exploded cross section view of the reusable adhesive bra of FIG. 9.
Figure 11B:
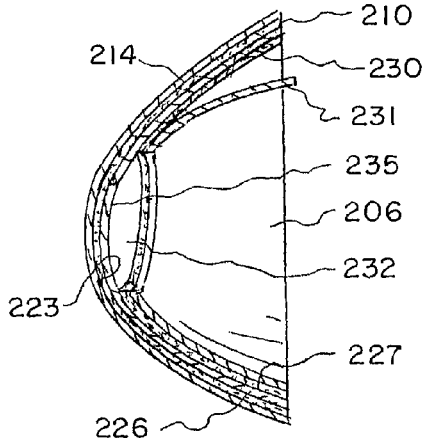
FIG. 11B is another cross section view of the reusable adhesive bra of FIG. 9.
Figure 12:
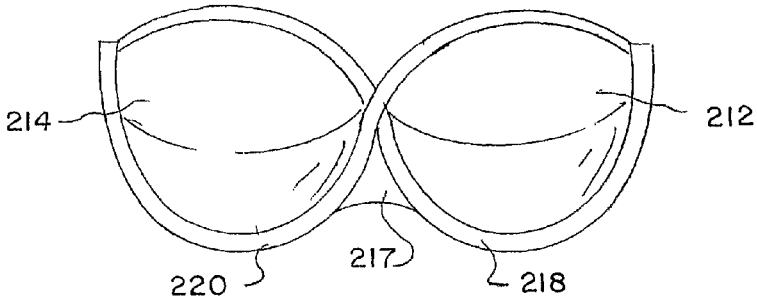
FIG. 12 is a front view of the reusable adhesive bra of FIG. 9.
Figure 13A:
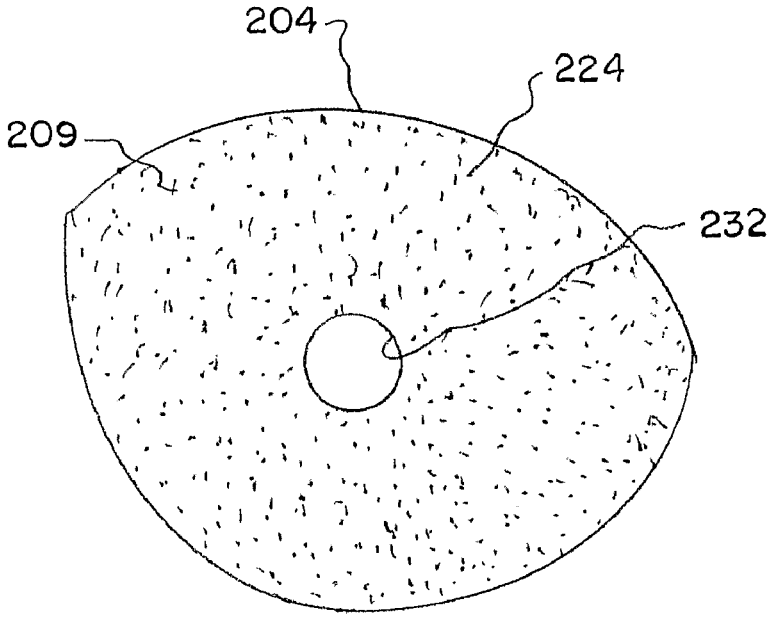
FIG. 13A is a front view of a reusable adhesive breast form of FIG. 9.
Figure 13B:
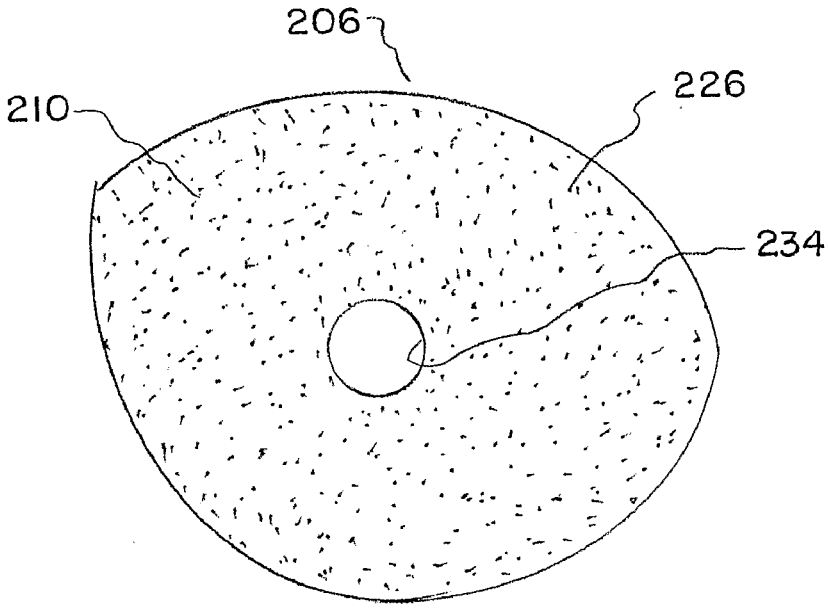
FIG. 13B is a front view of another reusable adhesive breast form of FIG. 9.

FIGS. 1 and 2 show an embodiment of the present invention, a reusable adhesive bra 10 comprising bra cups 12 and 14, and an elastic strip of material 17 fastened to edges 18 and 20 of the bra cups 12 and 14, respectively. The bra cups 12 and 14, have inner surfaces 22 and 24, respectively. The inner surface 22 of the bra cup 12 has pressure sensitive silicone gel adhesive 26 covered by peelable protective film 28, and the inner surface 24 of the bra cup 14 has pressure sensitive silicone gel adhesive 30 covered by peelable protective film 32. The inner surface 22 of the bra cup 12 has substantially centrally disposed portion 34 absent the pressure sensitive silicone gel adhesive 26, and exposes fabric or soft material 36 of the bra cup 12. The inner surface 24 of the bra cup 14 has substantially centrally disposed portion 38 absent the pressure sensitive silicone gel adhesive 30, and exposes fabric or soft material 40 of the bra cup 14.

The peelable protective film 28 and 32 are removed from the pressure sensitive silicone gel adhesive 26 and 30 of the bra cup 12 and 14, respectively, prior to placing the reusable adhesive bra 10 on the user's breasts. The reusable adhesive bra 10 is placed on the user's breasts with the pressure sensitive silicone gel adhesive 26 and 30 of the bra cup 12 and 14, respectively, removably adhering to the user's breasts and the substantially centrally disposed portion 34 and 38 of the to bra cup 12 and 14 absent the pressure sensitive silicone gel adhesive 26 and 30, respectively, about the user's nipples and the fabric or soft material 36 and 40 of the bra cups 12 and 14, respectively, adjacent and contacting the user's nipples. After use the reusable adhesive bra 10 is removed from the user's breasts, the peelable protective film 28 and 32 is replaced on the bra cup 12 and 14, respectively. The reusable adhesive bra 10 may be reused multiple times, even after washing.

FIGS. 3-8 show an alternate embodiment of a reusable adhesive bra 100, which is substantially the same as the reusable adhesive bra 10, except that the reusable adhesive bra 100 has fabric bra 102 and reusable adhesive breast forms 104 and 106, each of which are removably fastened to the fabric bra 102.

The fabric bra 102 has hook and loop fasteners 107 and 108 and the reusable adhesive breast forms 104 and 106 have hook and loop fasteners 109 and 110, respectively, for removably fastening the reusable adhesive breast forms 104 and 106 to the fabric bra 102.

The fabric bra 102 comprises bra cups 112 and 114 and an elastic strip of material 117 fastened to edges 118 and 120 of the bra cups 112 and 114, respectively. The bra cups 112 and 114 of the fabric bra 102 have inner surfaces 122 and 123, respectively. The inner surface 122 of the bra cup 112 of the fabric bra 102 has the hook and loop fasteners 107 fastened thereto in an annular pattern; and the inner surface 123 of the bra cup 114 of the fabric bra 102 has the hook and loop fasteners 108 fastened thereto in an annular pattern.

The reusable adhesive breast form 104 has outer surface 124 and inner surface 125; and the reusable adhesive breast form 106 has outer surface 126 and inner surface 127.

The outer surface 124 of the breast form 104 has the hook and loop fasteners 109 fastened thereto in an annular pattern, substantially the same as the annular pattern to of the hook and loop fasteners 107 of the bra cup 112 of the fabric bra 102, the hook and loop fasteners 109 of the breast form 104 removably fastening and mating with the hook and loop fasteners 107 of the bra cup 112. The outer surface 126 of the breast form 106 has the hook and loop fasteners 110 fastened thereto in an annular pattern, substantially the same as the annular pattern of the hook and loop fasteners 108 of the bra cup 114 of the fabric bra 102, the hook and loop fasteners 110 of the breast form 106 removably fastening and mating with the hook and loop fasteners 108 of the bra cup 114.

The inner surface 125 of the reusable adhesive breast form 104 has pressure sensitive silicone gel adhesive 128 covered by peelable protective film 129. The inner surface 127 of the reusable adhesive breast form 106 has pressure sensitive silicone gel adhesive 130 covered by peelable protective film 131.

The reusable breast form 104 has substantially centrally disposed hole 132 therethrough that exposes fabric or soft material 133 of the inner surface 122 of the bra cup 112 of the fabric bra 102, when the reusable breast form 104 is removably fastened to the bra cup 112 of the fabric bra 102. The reusable breast form 106 has substantially centrally disposed hole 134 therethrough that exposes fabric or soft material 135 of the inner surface 123 of the bra cup 114 of the fabric bra 102, when the reusable breast form 106 is removably fastened to the bra cup 114 of the fabric bra 102.

A user can, thus, replace and/or use alternate ones of the breast forms 104 and 106 with the fabric bra 102 having, for example, different shapes that the user may desire to use for different functions, or events, or to accentuate the user's breasts differently from time to time.

Alternatively, the user can use different ones of the fabric bra 102 with the breast forms 104 and 106 similarly to replace and/or change the appearance of the user's breasts at different times.

FIGS. 9-13B show an alternate embodiment of a reusable adhesive bra 200, which is substantially the same as the reusable adhesive bra 10, except that the reusable adhesive bra 200 has fabric bra 202 and reusable adhesive breast forms 204 and 206, each of which are removably fastened to the fabric bra 202.

The reusable adhesive breast forms 204 and 206 have pressure sensitive silicone gel adhesive 209 and 210, respectively, for removably fastening the reusable adhesive breast forms 204 and 206 to the fabric bra 202.

The fabric bra 202 comprises bra cups 212 and 214 and an elastic strip of material 217 fastened to edges 218 and 220 of the bra cups 212 and 214, respectively. The bra cups 212 and 214 of the fabric bra 202 have inner surfaces 222 and 223, respectively.

The reusable adhesive breast form 204 has outer surface 224 and inner surface 225; and the reusable adhesive breast form 206 has outer surface 226 and inner surface 227.

The outer surface 224 of the breast form 204 has the pressure sensitive silicone gel adhesive 209, the pressure sensitive silicone gel adhesive 209 of the breast form 204 removably fastening the breast form 204 to the bra cup 212. The outer surface 226 of the breast form 206 has the pressure sensitive silicone gel adhesive 210, the pressure sensitive silicone gel adhesive 210 of the breast form 206 removably fastening the breast form 206 to the bra cup 214.

The inner surface 225 of the reusable adhesive breast form 204 has pressure sensitive silicone gel adhesive 228 covered by peelable protective film 229. The inner surface 227 of the reusable adhesive breast form 206 has pressure sensitive silicone gel adhesive 230 covered by peelable protective film 231.

The reusable breast form 204 has substantially centrally disposed hole 232 therethrough that exposes fabric or soft material 233 of the inner surface 222 of the bra cup 212 of the fabric bra 202, when the reusable breast form 204 is removably fastened to the bra cup 212 of the fabric bra 202. The reusable breast form 206 has substantially centrally disposed hole 234 therethrough that exposes fabric or soft material 235 of the inner surface 223 of the bra cup 214 of the fabric bra 202, when the reusable breast form 206 is removably fastened to the bra cup 214 of the fabric bra 202.

The outer surface 224 of the breast form 204 is covered by peelable protective film 236, and the outer surface 226 of the breast form 206 is covered by peelable protective film 237, the peelable protective films 236 and 237 protecting the pressure sensitive silicone gel adhesive 209 and 210 of the breast forms 204 and 206, respectively, when the breast forms 204 and 206 are stored and not removably fastened to the bra cups 212 and 214, respectively, of the fabric bra 202.

A user can, thus, replace and/or use alternate ones of the breast forms 204 and 206 with the fabric bra 202 having, for example, different shapes that the user may desire to use for different functions, or events, or to accentuate the user's breasts differently from time to time.

Alternatively, the user can use different ones of the fabric bra 202 with the breast forms 204 and 206 similarly to replace and/or change the appearance of the user's breasts at different times.

FIGS. 14 and 15 show an alternate embodiment of a reusable adhesive bra 300, comprising a shaped flexible film 302, having an inner surface layer of pressure sensitive adhesive 304 covered by a sheet of protective film 306.

The shaped flexible film 302 has mid section 308, upwardly curved bottom edges 310 and 312, slightly downwardly curved top edges 314 and 316, upper sides 318 and 320 that extend upward to form wings 322 and 324, and substantially centrally disposed portion 326 of the shaped flexible film 302 absent the pressure sensitive adhesive.

FIGS. 16A-16D show perspective views of steps of a user placing the reusable adhesive bra 300 of FIG. 14 on a user's breast.

Prior to placing the reusable adhesive bra 300 on the user's breast, the breast area should be washed thoroughly. Soaps with oil or moisturizer should not be used. Skin should be rinsed completely of all residue and dried thoroughly prior to application of the reusable adhesive bra 300. Powders, moisturizers, oils, or fragrances should not be used anywhere near the breast area prior to applying the reusable adhesive bra 300.

The reusable adhesive bra 300 should not be used to enhance or lift the breast beyond normal support. If there is any doubt as to true bra size, a bra fitter should be consulted.

The steps of applying the reusable adhesive bra to a user's breast are shown in FIGS. 16A-16D, and described, as follows:

Slowly peel off one side of the bra front wax coated paper, as shown in FIG. 16A;

Lean forward slightly, allowing the breast to be positioned naturally in the center of the reusable adhesive bra 300, as shown in FIG. 16B;

Simply smooth on the reusable adhesive bra 300 by patting lightly with fingertips, starting in the lower middle of the breast working up and around the entire breast, as shown in FIG. 16C;

Repeat the steps shown in FIGS. 16A-16C for the other breast, as shown in FIG. 16D.

When removing the reusable adhesive bra 300:

The reusable adhesive bra 300 should be peeled off gently while holding, the skin. This allows the silicone to peel off more easily. If any silicone residue exists, baby oil should be used to remove the silicone residue.

After removal the reusable adhesive bra 300:

The reusable adhesive bra 300 should be cleaned by cleaning the silicone with mild soap and water. The adhesive side should be placed upwards, with the fabric side down on a paper towel to dry naturally. The reusable adhesive bra 300 should then be placed back onto the wax coated paper for later use.

Figure 17:
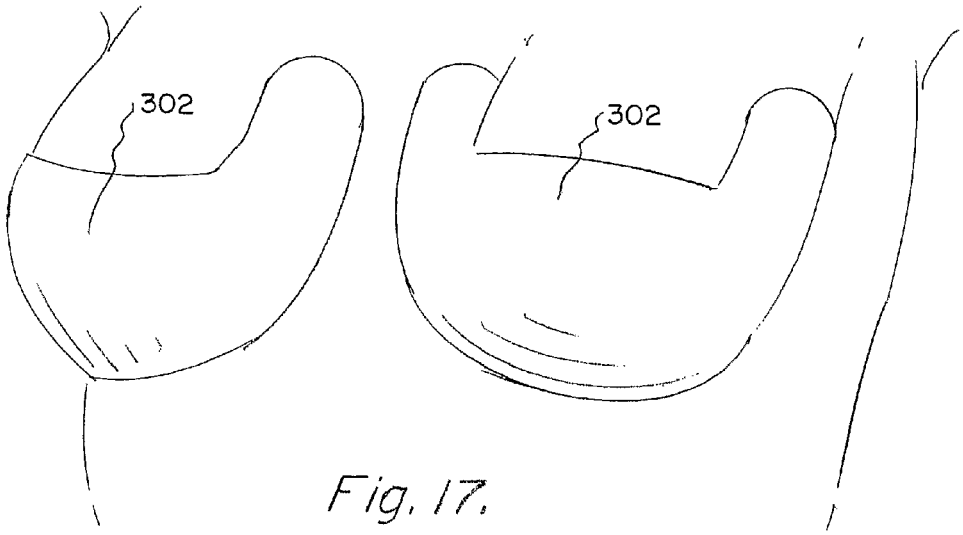
FIG. 17 is a perspective view of the reusable adhesive bra of FIG. 14 placed on the user's breasts.

FIG. 17 shows the reusable adhesive bra 300 of FIG. 14 placed on the user's breasts, after removal of the sheet of protective film 306, shown as the shaped flexible film 302 in FIG. 17.

Figure 18:
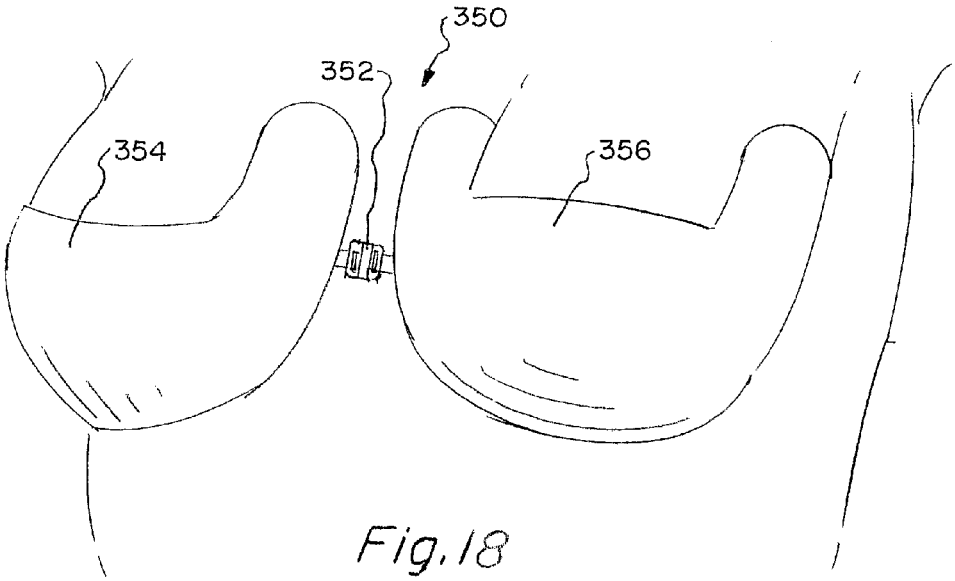
FIG. 18 is a perspective view of another reusable adhesive bra placed on the user's breasts.

FIG. 18 shows an alternate embodiment of a reusable adhesive bra 350 placed on a user's breasts, which is substantially the same as the reusable adhesive bra 300, except that the reusable adhesive bra 350 has connector 352 connecting reusable adhesive bra portions 354 and 356. The reusable adhesive bra 350 is shown after removal of the sheet of protective film.

Figure 19:
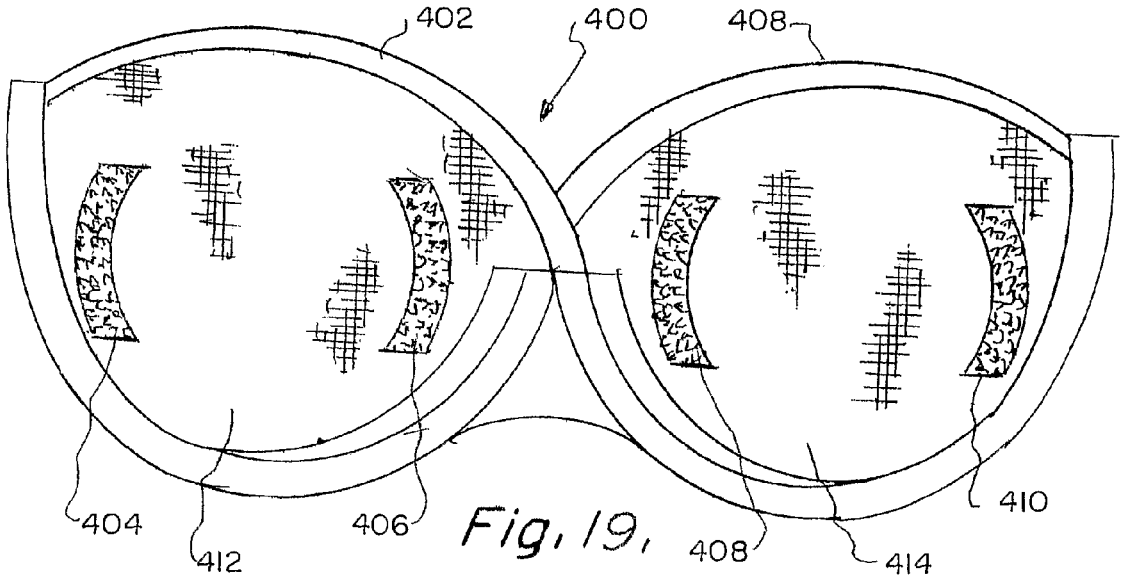
FIG. 19 is a rear view of another fabric bra having hook and loop fasteners.
Figure 20A:
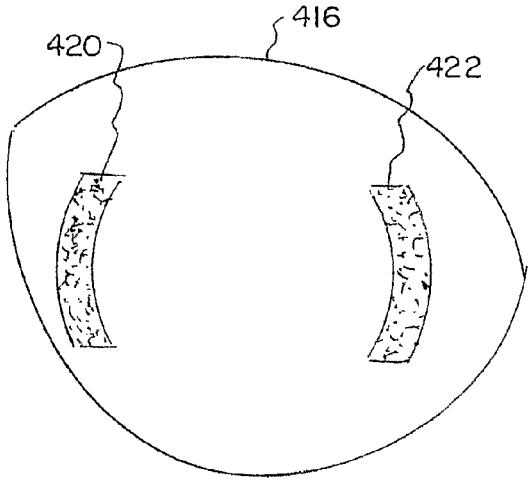
FIG. 20A is a front view of another reusable adhesive breast form having hook and loop fasteners for use with the other fabric bra of FIG. 19.
Figure 20B:
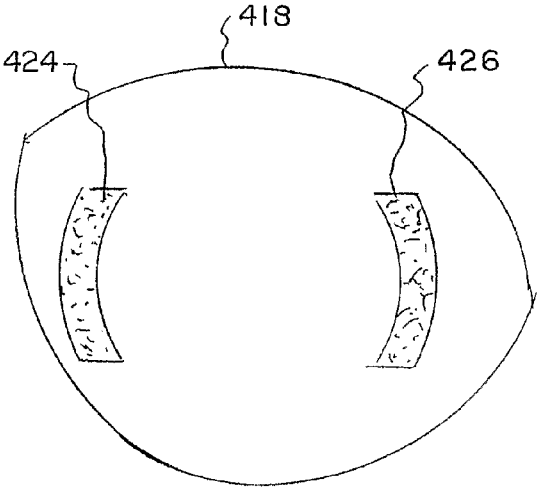
FIG. 20B is a front view of another reusable adhesive breast form having hook and loop fasteners for use with the other fabric bra of FIG. 19.
Figure 21:
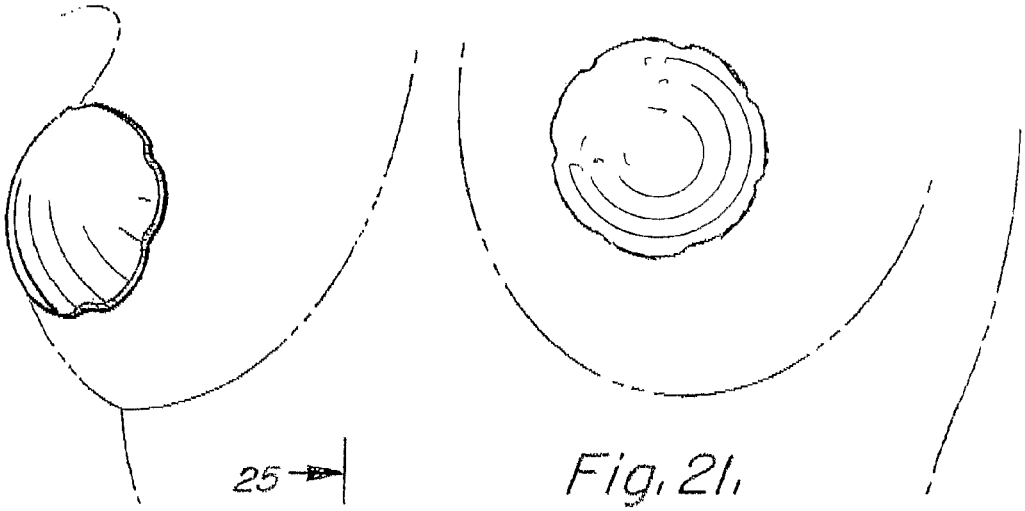
FIG. 21 is a perspective view of another reusable adhesive bra placed on a user's breasts.
Figure 22:
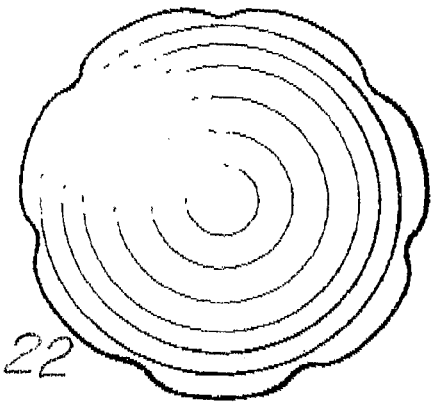
FIG. 22 is a front view of an adhesive bra cup of the reusable adhesive bra of FIG. 21.
Figure 23:
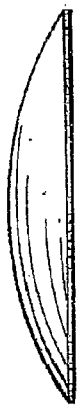
FIG. 23 is a side view of the adhesive bra cup of FIG. 22.
Figure 24:
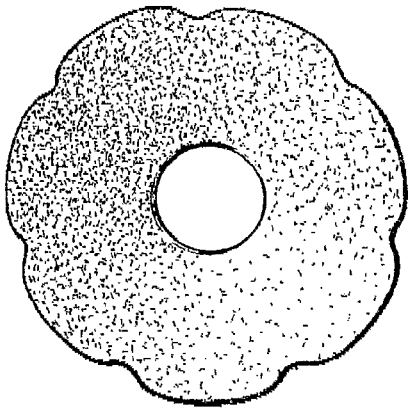
FIG. 24 is a rear view of the adhesive bra cup of FIG. 22.
Figure 25:
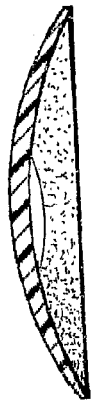
FIG. 25 is a cross section view of the adhesive bra cup of FIG. 22.

FIGS. 19 and 20 show an alternate embodiment of a reusable adhesive bra 400, which is substantially the same as the reusable adhesive bra 100, except that the reusable adhesive bra 400 has fabric bra 402, which has hook and loop fasteners 404, 406, 408 and 410 fastened to interior of cups 412 and 414 of the fabric bra 402 in an arcuate shaped pattern, and reusable adhesive breast forms 416 and 418, which have hook and loop fasteners 420, 422, 424, and 426 fastened to the reusable adhesive breast forms 416 and 418 also in an arcuate shaped pattern. The hook and loop fasteners 420, 422, 424, and 426 of the reusable adhesive breast forms 416 and 418 are removably fastened to and mate with the hook and loop fasteners 404, 406, 408 and 410 the fabric bra 402.

The hook and loop fasteners 420, 422, 424, and 426 of the reusable adhesive breast forms 416 and 418 are removably fastened to the reusable adhesive breast forms 416 and 418 in arcuate shaped patterns and the hook and loop fasteners 404, 406, 408 and 410 the fabric bra 402 are also fastened to the fabric bra 402 in arcuate patterns, although other suitable patterns may be used for each. Linear strips of hook and loop fasteners or rectangular shaped strips of hook and loop fasteners may be used, for example, or other suitable shapes may be used.

The reusable washable, adhesive layer of the present invention may be applied to nipple covers whether of the film or fabric type. The nipple covers can be in the shape of a flat petal or curved form, as shown, for example, in FIGS. 21-25. The central inner surface can contain a round pod of soft, flat felt-like material to isolate the nipples of the user from adhesive layer. The use of a round pad can also be applied to the nipple area of the cups and flat breast supports previously described.

Although the present invention has been described in considerable detail with reference to certain preferred versions thereof, other versions are possible. Therefore, the spirit and scope of the appended claims should not be limited to the description of the preferred versions contained herein.

What is claimed is:

1. A reusable adhesive bra, comprising:

a fabric bra having a pair of bra cups;

each of said bra cups having a forwardly facing surface and rearwardly facing surface;

a pair of bra forms each adapted to be matingly received in one of said bra cups;

each of said bra forms having a forwardly facing surface and a rearwardly facing surface;

each of said bra forms forwardly facing surfaces adapted to be removably fastened to a respective one of said bra cup rearwardly facing surfaces;

each of said bra forms having a substantially centrally disposed hole therethrough;

each of said bra forms rearwardly facing surfaces having a reusable adhesive coating adapted to be removably fastened to a respective one of a user's breasts and having said substantially centrally disposed hole surrounding a respective one of said user's nipples, when said respective one of said bra forms is removably fastened to said respective one of said bra cups.

2. The reusable adhesive bra according to claim 1 further including:

a peelable film covering said reusable adhesive coating.

3. The reusable adhesive bra accordingly to claim 1, wherein:

each of said bra form forwardly facing surfaces has a second, reusable adhesive coating for fastening to a respective one of said bra cup rearwardly facing surfaces.

4. The reusable adhesive bra according to claim 1, wherein:

each of said bra cup rearwardly facing surfaces of said fabric bra has at least one portion of hook and loop fasteners fastened thereto;

each of said bra form forwardly facing surfaces has at least one other portion of hook and loop fasteners thereto; and wherein each said at least one portion of hook and loop fasteners of said bra cups and each said at least one other portion of hook and loop fasteners of said bra forms are adapted to be removably fastened to a respective one of the other.

5. A process of manufacturing a reusable adhesive breast form adapted to be removably fastened in a bra cup, comprising:

providing a breast form having an outer surface and an inner surface;

applying a layer of unsaturated silicone comprising a thermally activated catalyst to a portion of said outer surface and to a portion of said inner surface; and heating said breast form and layer of unsaturated silicone to an elevated temperature to cure said layer of unsaturated silicone to produce a reusable pressure sensitive adhesive suitable for fastening to a bra cup and a user's breasts.

6. The process of claim 5 wherein said breast form inner surface defines a centrally disposed hole; and wherein said layer of unsaturated silicone is applied to said inner surface around said hole.

* * * * *